United States Patent [19]

Mazier

[11] 4,065,947

[45] Jan. 3, 1978

[54] COMPENSATORY EXPANSION BELLOWS AND ITS PRODUCTION

[76] Inventor: Paul Mazier, 64, route de Geneve, Rillieux La Pape, France, 69140

[21] Appl. No.: 747,103

[22] Filed: Dec. 3, 1976

[30] Foreign Application Priority Data

Dec. 5, 1975 France ..... 75.37883

[51] Int. Cl.[2] ..... B21D 15/06

[52] U.S. Cl. ..... 72/59; 72/62

[58] Field of Search ..... 72/57, 58, 59, 61, 62

[56] References Cited

U.S. PATENT DOCUMENTS

| | | | |
|---|---|---|---|
| 349,718 | 9/1886 | Hollerith | 72/59 |
| 2,044,710 | 6/1936 | Mantle | 72/59 |
| 2,583,315 | 1/1952 | Baites | 72/62 |
| 2,842,182 | 7/1958 | Cote | 72/59 |
| 3,091,280 | 5/1963 | Lowell | 72/59 |
| 3,194,041 | 7/1965 | Johnson | 72/59 |

*Primary Examiner*—Leon Gilden

*Attorney, Agent, or Firm*—Fleit & Jacobson

[57] ABSTRACT

Large diameter expanding bellows is described for pipe systems produced by the invention from portable apparatus combining fixed and slidable rings, the former connected to an end of and the latter sealably mounted on a sleeve and a skirt slideable into sealing relationship with the former and connected to the slideable ring, pressure fluid admission means communicating with the annular space between the rings and an outlet for regulation of liquid flow therefrom; a sleeve 1 may be strengthened by a core 3 of cement and fitted with a dismountable ring 4 co-operative with a displaceable ring 6 connected to an upper skirt 8 defining a chamber in communication with a pump 15 for introducing fluid in hydroforming to lower fixed ring 4.

2 Claims, 4 Drawing Figures

COMPENSATORY EXPANSION BELLOWS AND ITS PRODUCTION

Priority is claimed from Dec. 5th, 1975, filing date in France : application No. 753 7883.

The present invention concerns expansion bellows with deformable corrugations mounted in pipe systems and the like industrial assemblies in order to compensate and encase deformations resulting from changes in the temperature of the fluid flowing through the particular pipe systems.

It is known that one of the methods currently employed for the production of this type of bellows consists in "hydroforming". In such a process, also known under the name of "hydroforming", a sheet metal collar is used which is longer in length than that of the bellows to be obtained, this length being in fact equal to the length between the cylindrical ends of the said bellows and the deformable corrugations thereof. This collar, preferably provided with end flanges, receives on it's outer wall a series of suitably spaced ribs, and it is placed on a fixed plate of a press. The inner space of the collar is filled with a liquid (flowing out) under control and the press is operated in such manner that the displaceable plate is applied against one of the ends of the assembly. As a result of the presence of the liquid the metal is forced to become deformed outwardly between the shaping rings so that finally the bellows is formed.

The power developed by the press is naturally a function of the diameter of the collars to be shaped, so that in order to produce bellows with large diameters, which would normally require presses of very high power, it has been decided to place the collar to be processed around a rigid core of a radius which is slightly smaller which thus defines with the inner wall of the said collar, a narrow annular space. This annular space is filled with liquid, the displaceable member of the press being arranged in such manner as to apply itself only against the cross-section of the said space. It will be understood that the power necessary for the shaping of the bellows is relatively weak, despite the diameter presented by the original collar.

Such a process operates very satisfactorily, but it obviously involves complicated and bulky equipment, only compatible with manufacture in a workshop. It is this advantage that the present invention proposes to surmount by means of a simple and economical device capable of being easily transported and hence making it possible to construct bellows in situ, that is to say, in the same premises intended to receive the particular bellows or in the immediate vicinity of the said bellows.

The device according to the present invention is characterised in that it comprises in combination a rigid vertical sleeve, a fixed ring connected to the upper part of the said sleeve, a displaceable ring mounted to slide with a sealing action thereon, a cylindrical skirt connected to the aforementioned displaceble ring and shaped so as to slide with a sealing effect on the fixed ring, means to admit under pressure a fluid into the annular chamber comprised between the two superimposed rings, and means of normal type to regulate the outflow of the liquid which fills the inner annular space of a collar to be shaped.

The appended drawings, given by way of example, will make it possible to understand more clearly the invention, the features thereof and the advantages it is capable of procuring.

Figure 1:
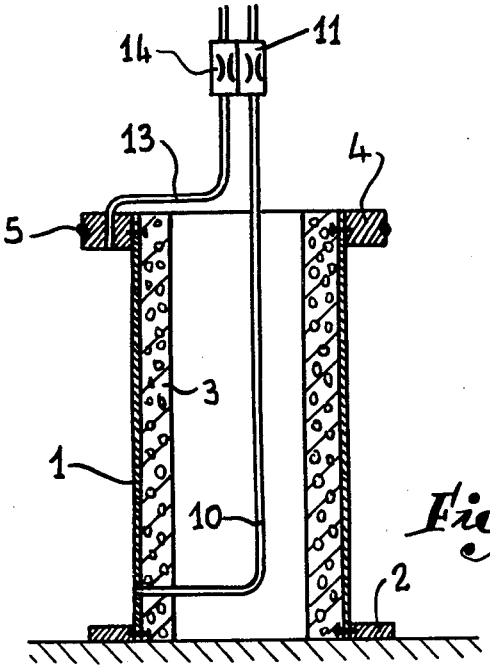
FIG. 1 shows a schematic vertical section showing the fixed members of the transportable device according to the present invention.

In order to construct an expanding bellows according to the present invention, a sleeve 1 (FIG. 1) is used having a diameter less than that of the ends of the bellows to be obtained, and a height greater than that of the collar used for this purpose. This sleeve 1, provided at its base with a reinforcing ring 2, which ensures its stability in the vertical position, is inwardly strengthened with a core 3 made by directly casting a mass of cement in the said sleeve. This core 3 may be tubular as shown, or solid. The upper end of the sleeve 1 is intended to receive in a removable manner a fixed ring 4 provided with an outwardly turned joint 5.

Figure 2:
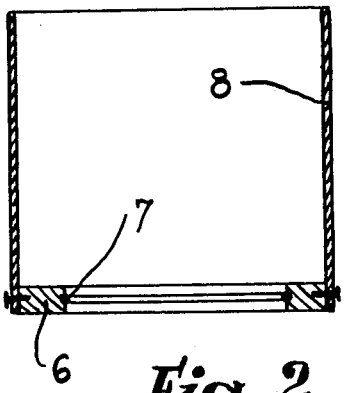
FIG. 2 shows in the same manner the displaceable parts of this device.
Figure 4:
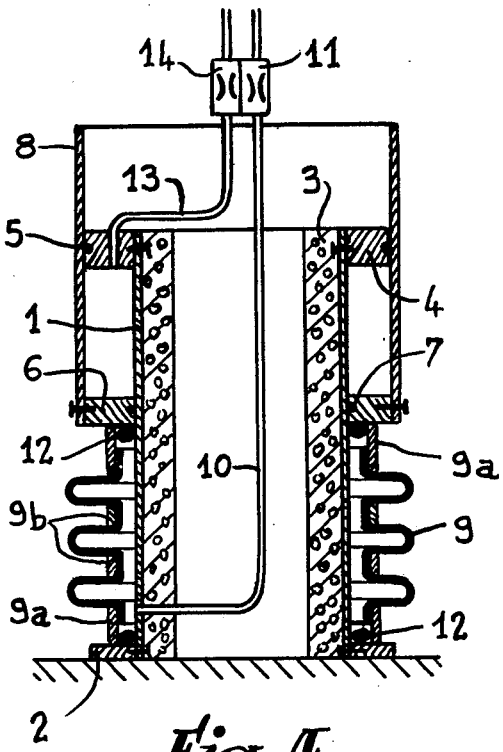
FIGS. 3 and 4 are similar sections showing the construction of a bellows.
Figure 3:
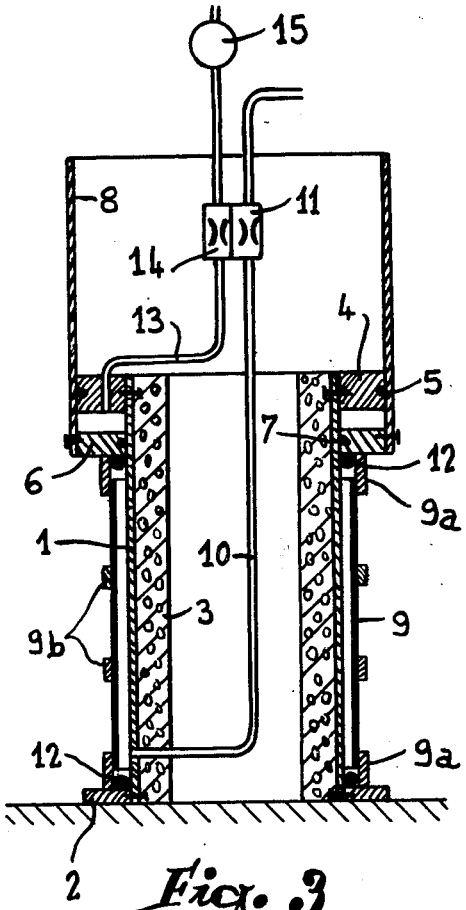

Prior to the assembling of the fixed ring 4, a displaceable ring 6, (FIG. 2) is engaged on the sleeve 1, said ring 6 being provided with a joint 7 disposed in such manner as to ensure that this ring slides with a sealing action on the said sleeve. The displaceable ring 6 is connected to an upwardly turned cylindrical skirt 8, the inner diameter of this skirt 8 being such that the latter slides with a sealing effect relatively to the joint 5 of the fixed ring 4, as shown in FIG. 3 which shows the parts in the assembled condition.

Since the rings 4 and 6 are assumed to be dismantled from the sleeve 3, the collar 9, intended for the formation of the bellows, is engaged thereon; in the usual manner this collar is provided at its ends with connecting flanges **9*a*, separated from each other by annular ribs 9*b*, provisionally kept in place by means of removable wedges (not shown). The annular space between the collar 9 and the sleeve 1 is filled with water or other liquid through a pipe 10 associated with a regulating device shown schematically by 11; this device 11 is arranged to monitor the presssure of the liquid, in the conventional manner in the technique of hydroforming. Removable joints 12, provide within the flanges 9*a***, ensure the tightness of the above-mentioned annular space.

Associated with the fixed ring 4 is a pipe 13 on which there is provided a regulating slide valve 14 which terminates in a pump shown schematically at 15. This pump 15 may be of any desired type since it is only necessary, in fact, for it to permit the admission of any fluid into the annular chamber defined by the two rings 4 and 6, the sleeve 1 and the displaceable skirt 8. The displaceable unit 6–8 is thus obliged to descend in the direction of the base 2, thus ensuring the formation of the bellows in the usual manner.

The assembly of the device is very simple so that it can be easily transported for constructing bellows in situ.

It should, however, be understood that the above description is given only by way of example and in no way limits the scope of the present invention which also includes the replacement of the described details of construction by any other equivalent details. In particular, in certain cases, the lower ring 2 may be provided to be easily dismantled in place of the fixed upper ring 4.

What I claim is:

1. A device for manufacture, by the hydroforming process, of expanding bellows for pipe systems from metal collars, characterised in that it comprises, in combination, a rigid sleeve for placement inside said metal collar and forming an inner annular space therebetween, a fixed ring connected to the outer surface of one end of said sleeve, a displaceable ring mounted concentric to said sleeve and located between said fixed ring and the other end of said sleeve and arranged to slide with a sealing action thereon and contacting an edge of said metal collar, a cylindrical skirt concentric to said sleeve and connected to said displaceable ring and having a length so as to slidably contact said fixed ring with a sealing effect thereby defining a closed variable volume annular chamber, means for admitting under pressure a fluid into the variable volume annular chamber formed between said sleeve and said skirt and bounded by said rings, and means to regulate the inflow and outflow of liquid into and out of the inner annular space between the collar to be shaped and the sleeve, whereby when said fluid is admitted under pressure to said variable volume annular chamber, said displacable ring and said skirt are displaced relative to said fixed ring thereby deforming the collar into a bellows.

2. Device according to claim 1, characterised in that said sleeve is inwardly strengthened by a core of cement directly cast in the interior of said sleeve.

* * * * *